US005514002A

United States Patent [19]

Cheng et al.

[11] Patent Number: 5,514,002

[45] Date of Patent: May 7, 1996

[54] ELECTRICAL CONNECTOR ASSEMBLY AND CONTACTS THEREIN

[75] Inventors: Lee M. Cheng, Cupertino; Conrad Choy, San Francisco, both of Calif.

[73] Assignee: Hon Hai Precision Ind. Co., Ltd., Taiwan

[21] Appl. No.: 234,245

[22] Filed: Apr. 28, 1994

[51] Int. Cl.[6] ..... H01R 13/62

[52] U.S. Cl. ..... 439/326; 439/637

[58] Field of Search ..... 439/326–328, 439/630–637, 59, 60, 62, 259, 260, 262, 924.1

[56] References Cited

U.S. PATENT DOCUMENTS

| | | | |
|---|---|---|---|
| 3,740,699 | 6/1973 | Johnson et al. | 439/637 |
| 4,990,107 | 2/1991 | Fortuna | 439/637 |
| 5,203,725 | 4/1993 | Brunker et al. | 439/60 |
| 5,259,793 | 11/1993 | Yamada et al. | 439/637 |
| 5,259,795 | 11/1993 | Yamada et al. | 439/637 |

*Primary Examiner*—Gary F. Paumen

*Assistant Examiner*—Hien D. Vu

[57] ABSTRACT

A socket connector (1) includes an insulative housing (10) having a central slot (12) therein along its lengthwise direction for receiving a lower edge portion (101) of a daughter board (100) therein. A plurality of passageways (14, 16) are arranged staggered on two sides along the slot (12) for receiving the upper row contacts (60) and the lower row contacts (80) therein for electrical engagement with the corresponding circuit traces (108) on two sides of the daughter board (100). Two arms (20) respectively extend forwardly from two ends of the housing (10) and each arm (20) thereon forms a platform (22) for allowing the inserted daughter board (100) to sit thereon. A metal latch (40) including a generally U-shaped body (46) and a retention blade (44) separately and respectively independently extend from a main base (42) so that the latch (40) can be reliably securely retained horizontally within each arm (20) of the housing (10) wherein the hook (54) of the latch (40) upwardly extends out of the platform (22) for engagement with the daughter board (100) thereon, and the lever (56) of the latch (40) extends forwardly out of the front end surface (21) of the arm (20) for easy manually operative deflection.

12 Claims, 7 Drawing Sheets

ELECTRICAL CONNECTOR ASSEMBLY AND CONTACTS THEREIN

BACKGROUND OF THE INVENTION

1. Field of The Invention

The invention relates to card edge electrical connectors, particularly to a SIMM socket having miniature dimensions and lying on a mother board for use within a laptop computer.

2. The Prior Art

SIMM (Single In-Line Memory Module) is popularly used in the personal computer, so the SIMM socket connector is also commonly adopted, to a greater amount, to be an interface between the mother board and such SIMM in the computer industry. As well known, the typical early SIMM socket connector can be referred to U.S. Pat. Nos. 4,832,617 and 4,850,892 showing connectors having integral plastic latches thereof for retaining an inserted daughter board. Later, a separate metal latch substitutes such integral plastic latch for easy and long life-time operation, for example, U.S. Pat. Nos. 4,986,765, 4,995,825, 5,004,429, 5,094,624, 5,100,337, 5,112,242, 5,123,857, 5,145,395, 5,154,627, 5,161,995, 5,174,778, 5,174,780, 5,234,354, 5,244,403, 5,273,451 and 5,286,217. As experienced and shown in aforementioned U.S. Pat. Nos. 4,986,765, 4,995,825, 5,100,337, 5,112,242 and 5,174,778, a U-shaped metal latch is preferably desired due to its inherent good structural resilience which allows easy deflection and reliable recovery.

One disadvantage may be found in that design that strict manufacturing tolerance and precision of the dimensions of the separate metal latch and the corresponding portions of the housing are generally required, which increase production complexity. The reason for this strict request results from a portion of such U-shaped body of the latch also being retention means for retaining the latch within a corresponding pocket, thus causing the significance of the dimensions of the U-shaped body of the latch which intends to not only reliably and effectively retain the latch within pocket of the housing, but also provide the latch itself with outstanding resilience wherein such resilience has a superior elasticity coefficient allowing for not only easy operative deflection but also complete recovery to effectively holding the daughter board within the socket connector.

Most other designs as shown in the aforementioned U.S. Pat. Nos. use a generally simple straight beam to replace such U-shaped body of the latch for simplifying the manufacturing procedure. Although the simple straight beam type latch can be easily fabricated and attachably assembled to the housing, the resilience thereof is inferior to that of the U-shaped body latch. Using a soft material of such latch may allow for easy operative deflection of the latch, but also tend to fail to completely recover the latch after its deflection. Thus, this permanent deformation of the latch precludes the daughter board from being effectively retained within the socket connector. In contrast, using a strong material of the latch may guarantee no permanent deformation of the latch to efficiently retaining the daughter board in the socket connector, but the stiffness of the latch precludes easy operative deflection thereof.

Therefore, an object of the present invention is to provide latch means having the advantage of the good resilience of the U-shaped body thereof, but without the aforementioned disadvantage of manufacturing problems of the U-shaped body as shown in the above-described patents.

It is noted that different from a conventional SIMM socket connector mountably standing on the mother board, a Mini-SIMM socket connector used in a laptop computer lies on the mother board for decreasing the height of the computer set wherein the upper row contacts and the lower row contacts are arranged staggered along the slot of the connector housing.

Another object of the invention is to provide upper row and lower row contacts in the socket connector, each of which has an extended longer curved configuration to provide a good resilience thereof for low insertion force of the inserted daughter board. Also, the elasticity coefficient of the upper row contact and that of the lower row contact are generally equal to each other so that the inserted daughter board in the socket connector can properly receive the balanced forces on its two opposite surfaces.

Yet an object of the invention is to provide a retaining bracket which is designed to be mounted to the mother board for retaining the socket connector on such mother board and is individually separated from the latch so that the force acting on the latch will not be directly transferred to the retaining bracket to influence the retention of the retaining bracket with the mother board.

SUMMARY OF THE INVENTION

According to an aspect of the invention, a socket connector includes an insulative housing having a central slot therein along its lengthwise direction for receiving a lower edge portion of a daughter board therein. A plurality of passageways are arranged staggered on two sides along the slot for receiving the upper row contacts and the lower row contacts therein for electrical engagement with the corresponding circuit traces on two sides of the daughter board. Two arms respectively extend forwardly from two ends of the housing and each arm thereon forms a platform for allowing the inserted daughter board to sit thereon. A metal latch including a generally U-shaped body and a retention blade separately and respectively independently extend from a main base so that the latch can be reliably securely retained horizontally within each arm of the housing wherein the hook of the latch upwardly extends out of the platform for engagement with the daughter board thereon, and the lever of the latch extends forwardly out of the end of the arm for easy manually operative deflection.

The upper row contact and the lower row contact have generally the similar base sections and the engagement beams of the upper row contact and the lower row contact both upwardly curvedly extend generally at the same positions first rearward to reach adjacent the rear surface of the housing and successively forwardly to respectively enter two sides of the central slot wherein the engagement beams of the upper row contact and of the lower row contact are provided with a generally equal elasticity coefficient so that the lower edge portion of the inserted daughter board can be retainably properly balanced in the such slot in the housing.

DETAILED DESCRIPTION OF THE PREFERRED EMBODIMENT

References will now be made in detail to the preferred embodiments of the invention. While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 1:
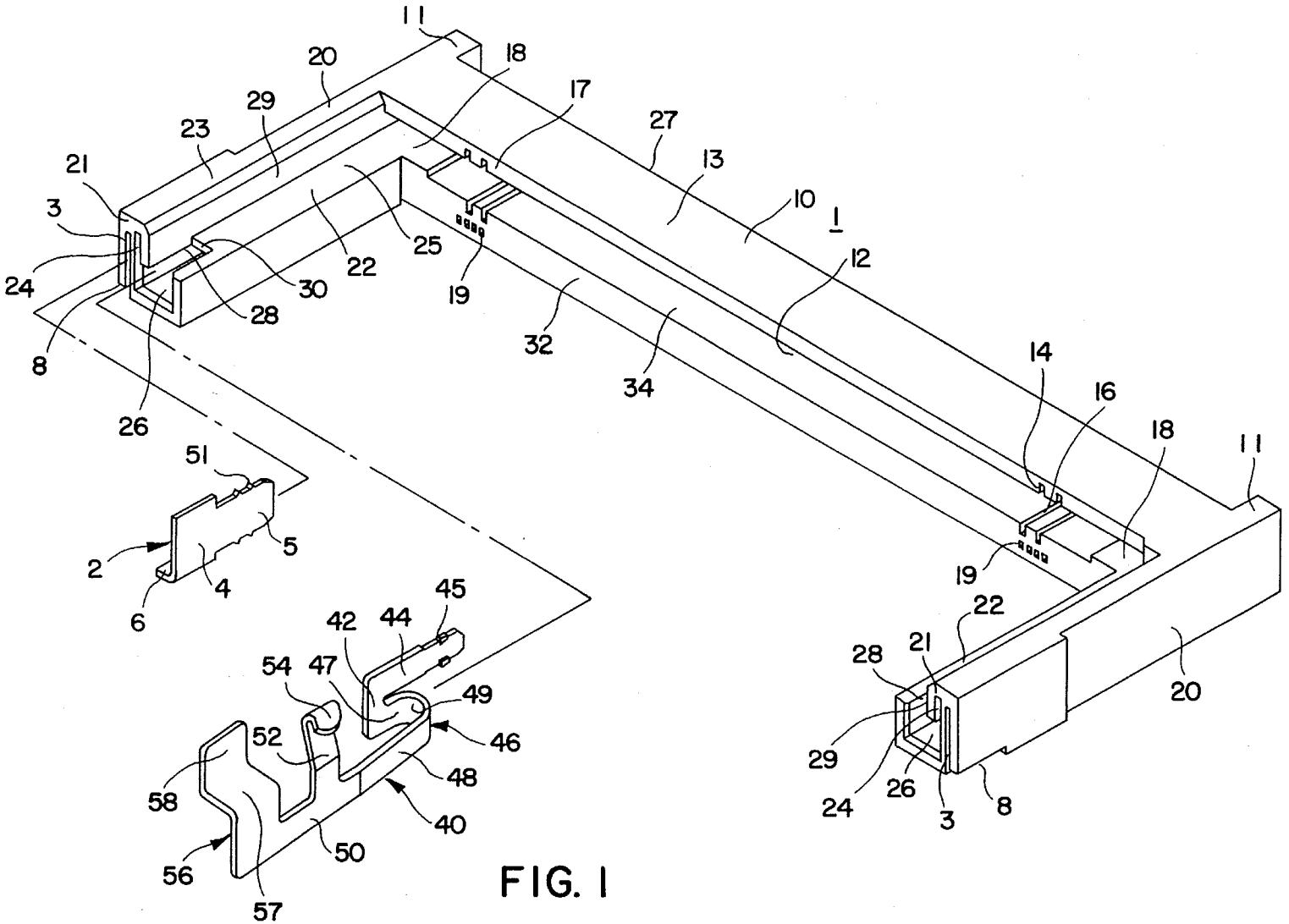
FIG. 1 is an exploded perspective view of a presently preferred embodiment of the socket connector according to the invention wherein contacts are not shown and only the left side latch and retaining bracket are shown for illustration.
Figure 2A:
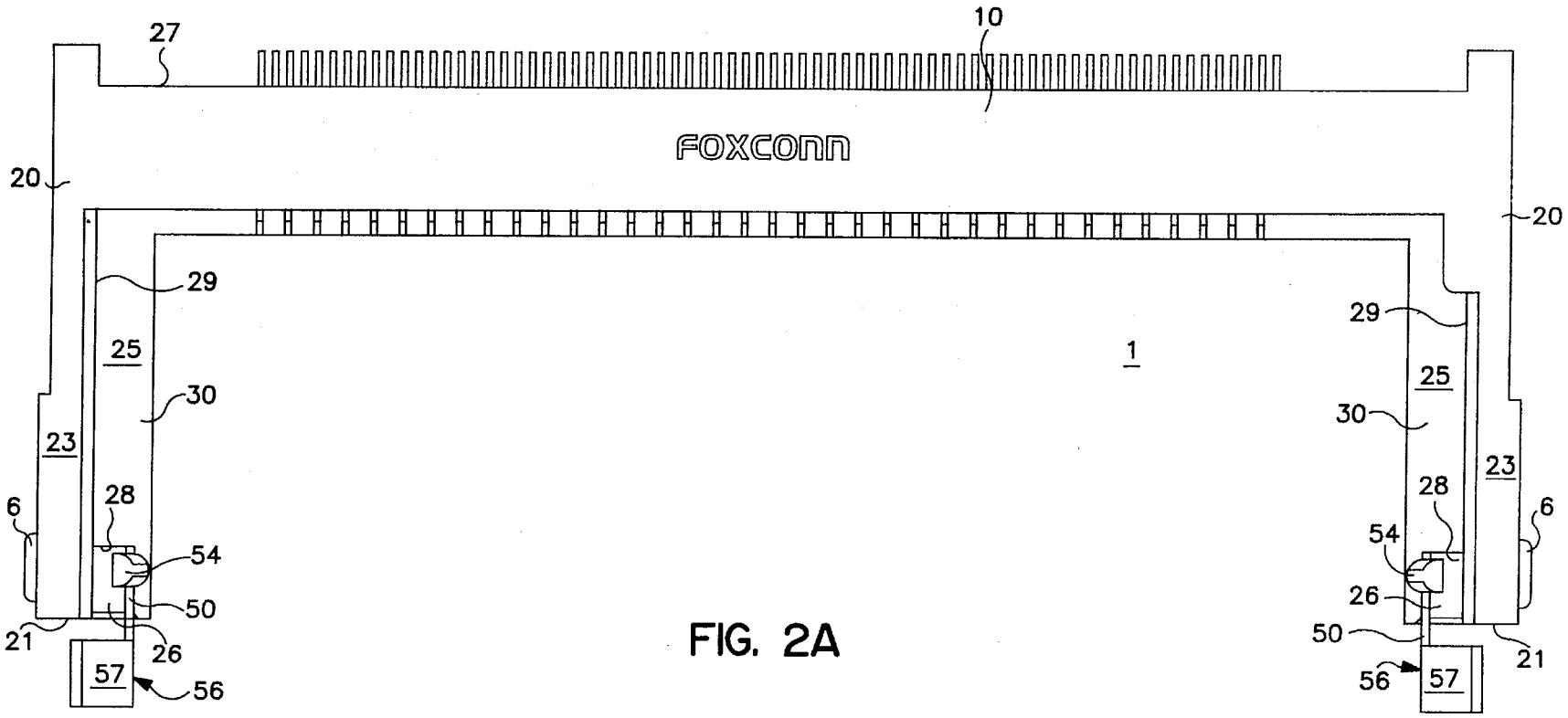
FIG. 2(A) is a top plane view of the socket connector of FIG. 1 associated with contacts therein.
Figure 2B:
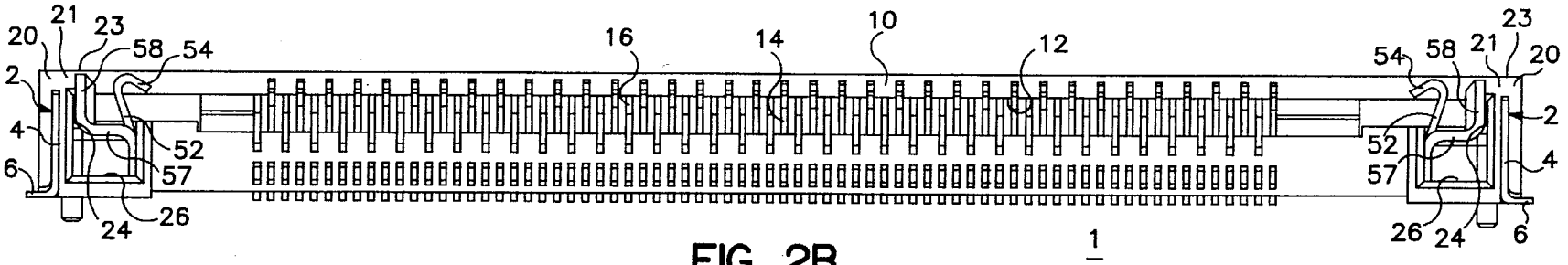
FIG. 2(B) is a front plane view of the socket connector of FIG. 1 associated with contacts therein.

It will be noted here that for a better understanding, like components are designated by like reference numerals throughout the various figures in the embodiment. Attention is now directed to FIG.1 wherein a Mini-SIMM socket connector 1 includes an insulative housing 10 having a central board slot 12 therein extending in a lengthwise direction along the housing 10 for receiving a lower edge portion of a daughter board (not shown in FIG. 1) therein.

A plurality of upper row passageways 14 and a plurality of lower row passageways 16 are arranged staggered one another along the slot 12 for receiving the corresponding upper row contacts and lower row contacts (not shown in FIG. 1) therein, respectively. The passageways 14, 16 and the corresponding contacts therein will be described in detail later. Two standoffs 18 are positioned adjacent two opposite ends of the housing 10.

A pair of elongated engagement arms 20 extend forwardly at two opposite ends of the housing 10. Each engagement arm 20 has a lateral extended horizontal platform 22 which is generally coplanar with the top surface of the adjacent corresponding standoff 18. Opposite to each engagement arm 20, an extension bar 11 integrally extends rearward from the housing 10 whereby the tails of the contacts of the connector 1 which rearward project from the rear surface 27 of the housing 10 are aligned between this two extension bars 11.

A metal latch 40 is designedly secured to each arm 20. The metal latch 40 includes a vertical main base 42 of which from the rear edge of the upper half portion a retention blade 44 extends rearward having barbs 45 thereon and from the rear edge of the lower half portion a generally U-shaped body 46 extends wherein the U-shaped body 46 comprises an outer leg 47 extending integrally from the main base 42, an inner leg 48 spaced apart from the outer leg 47, and a bight 49 intermediating therebetween. An extension section 50 integrally extends forwardly from which a hook section 52 upwardly and outwardly slantingly extends adjacent the inner leg 48 of the U-shaped body 46. An inwardly projecting hook 54 is positioned at the top of the hook section 52. A right angle lever section 56 extending upwardly from the distal end of the extension section 50, includes a horizontal portion 57 integrally connected to the extension section 50, and a vertical portion 58 positioned above the horizontal portion 57 for easy manual operation.

Both referring to FIGS. 1, 2(A) , 2(B) and 3(A) , the engagement arm 20 has a slit-like groove 24 rearward extending a distance X from the front end surface 21 of the arm 20 into the rearward portion of the engagement arm 20. The groove 24 is formed to allow the main base 42 of the latch 40 to be inserted into the arm 20 and received therein. The rear portion of such groove 24 is shortened to has a half dimension thereof for receiving the retention blade 44 therein wherein the barbs 45 of the retention blade 44 interferentially engage the corresponding portions of housing 10. Communicatively adjacent such groove 24, a cavity 26 extends from the front end surface 21 of the arm 20 into the platform 22 and terminates in a distance Y wherein Y is smaller than X. The cavity 26 is designed to receive the U-shaped body 46 and a portion of the extension section 50 of the latch 40 therein. From the front end surface 21 of the arm 20, an opening 28 extends a distance Z through the top wall 30 of the platform 22, which is positioned above the cavity 26, wherein Z is smaller than Y. Therefore, when the latch 40 is received into the cavity 26, the hook section 50 can upwardly project from the cavity 26 and through the opening 28 wherein the hook 54 is generally positioned flush with top surface 23 of the arm 20. The lever 56 is exposed in front of the arm 20 so that it is convenient to operatively deflect the latch 50 outwardly by imposing an horizontal outward force onto the vertical portion 58 of the lever 56.

Figure 4:
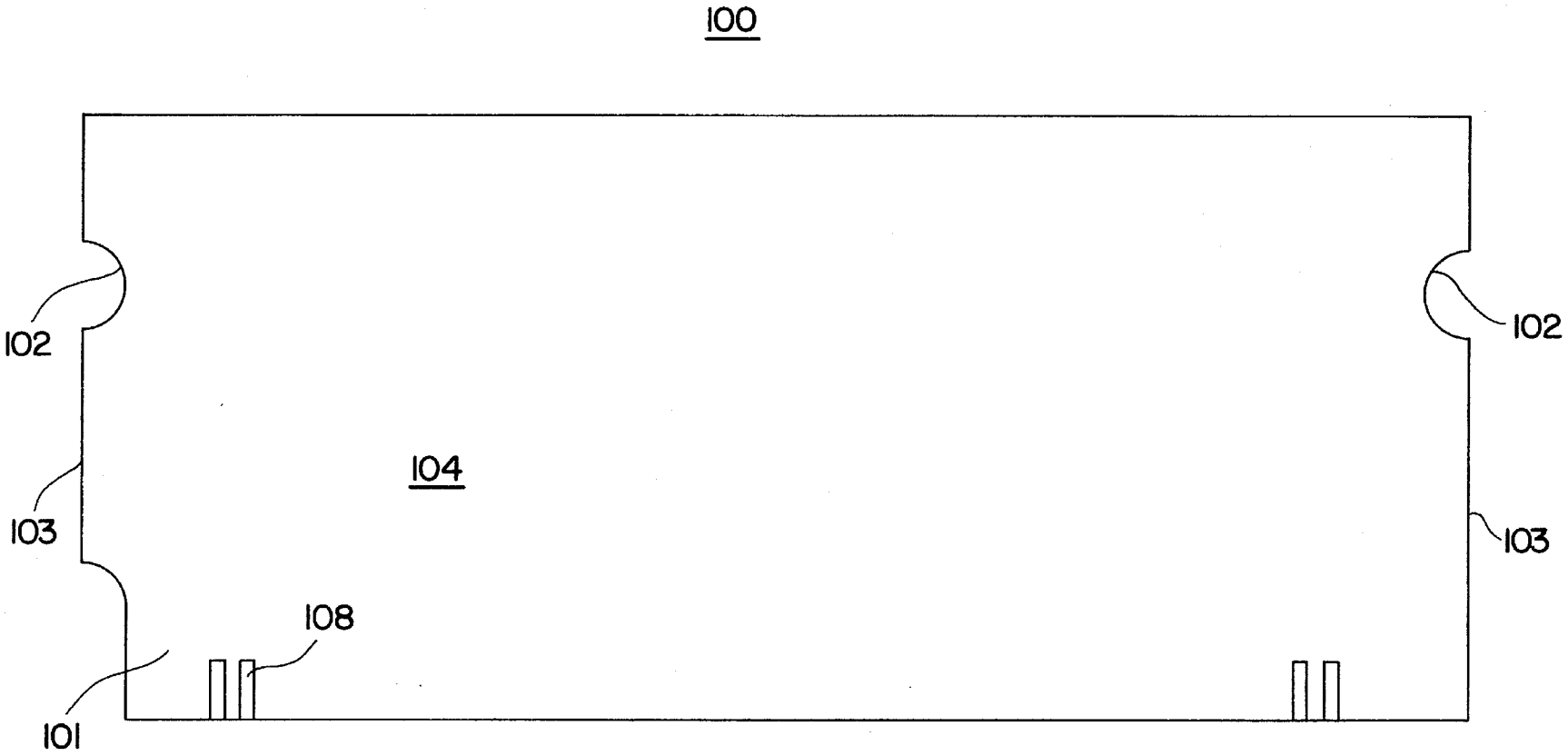
FIG. 4 is a front view of a daughter board adapted to be inserted into the socket connector of FIG. 1.

It should be known that different from the standard SIMM board which has two complete round holes respectively at two sides, as shown in FIG. 4, the daughter board 100 used in Mini-SIMM socket connector 1 includes a pair of notches 102 formed at two side edges. Similar to the standard SIMM board, the lower edge portion 101 of the daughter board 100 can be inserted into to the central slot 12 of the housing 10 at a angle within a predetermined range (please referring to FIGS. 1, 2(A), 2(B), 6(A) and 6(B)), and then rotated downward to lie on a plane defined by two top surfaces 25 of the platform 22. During this rotation period, the hook 54 and hook section 52 of the latch 40 are outwardly deflected by engagement with the portion of the board 100 around the notch 102 for allowing the downward movement of the board 100. Understandably, the hook section 52 of the latch can be recovered with its own resilience to be in a normal straight condition after the whole (thickness of) daughter board 100 passes through the hook 54 of the latch 40. Under this situation, the hook 54 can press against the top surface 104 of the board 100, the top surfaces 25 of the platform 22 abut against the bottom surface 106 of the board 100, and the hook section 52 extends through the notch 102 whereby the board 100 is restrained to move either back and forth or up and down. It can be understood that in this condition the daughter board 100 is positioned between these two engagement arms 20 and two side edges 103 of the daughter board 100 substantially confront the inner side surfaces 29 of the arms 20, respectively.

As a result, the contact of the connector 1 can be mechanically and electrically engaged with the circuit traces 108 on the top surface 104 and the bottom surface 106 of the lower edge portion 101 of the board 100. Similar to the standard SIMM board, the daughter board 100 can be removed from the housing 10 by horizontally imposing a force against the vertical portion 58 of the lever 56 of the latch 40 to outwardly deflect the hook section 52 and its above associated hook 54 for unlocking the board 100, and the resilience of the contacts in the housing 10 can push the daughter board 100 slantingly upwardly. Thus, the board 100 can be withdrawn from the socket connector 1.

Figure 5B:
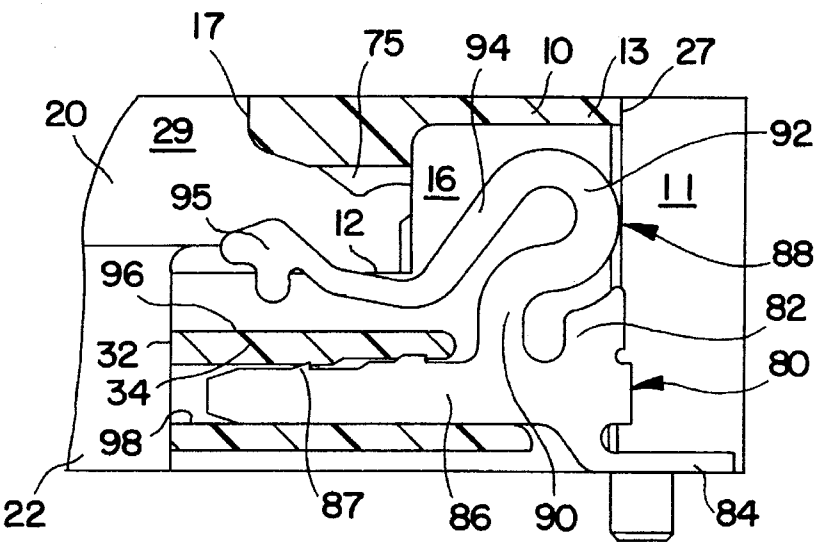
FIG. 5(B) is a partial cross-sectional view of the socket connector of FIG. 1 to show the lower row contact therein.
Figure 5A:
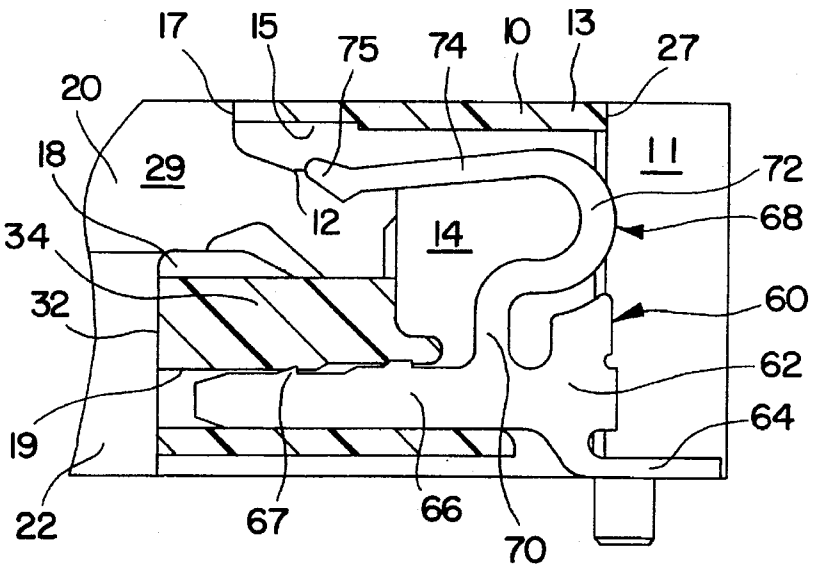
FIG. 5(A) is a partial cross-sectional view of the socket connector of FIG. 1 to show the upper row contact therein.
Figure 6A:
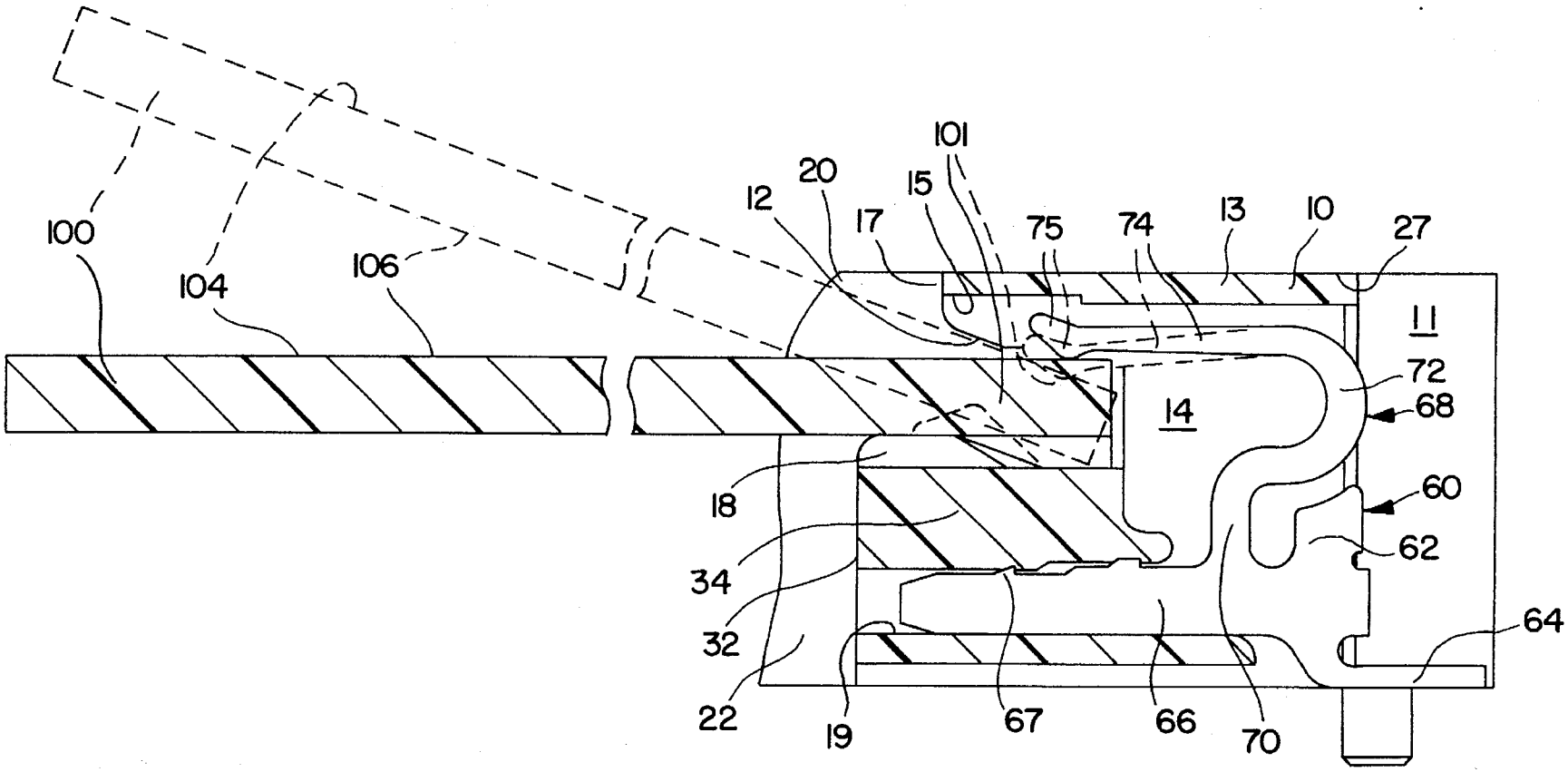
FIG. 6(A) is a partial cross-sectional view of the socket connector of FIG. 1 to show the upper row contact therein when the daughter board is inserted therein.

Referring to FIGS. 1, 5(A) and 6(A), an upper row contact 60 is received within the upper row passageway 14. The upper row contact 60 has a base 62 section from which a mounting leg 64 extends downward and backward and a retention section 66 extends forward wherein the retention section 66 has barbs 67 thereon. An engagement beam 68 upwardly extends from the rear portion of the retention section 66 adjacent the base section 62. Such engagement beam 68 includes a vertical first section 70 extending from the retention section 66, a curved second section 72 successively extending backwardly and upwardly from the top of the first section 70 wherein the rear edge of such second section 72 somewhat projects out of the rear surface 27 of the housing 10. A generally horizontal third section 74 extends from the end of the second section 72 and the free end 75 of the third section 74 projects into the central slot 12 for engagement with the corresponding circuit traces 108 on the top surface 104 of the inserted board 100. Correspondingly, the upper row passageway 14 includes an upper channel 15 rearward extending from front surface 17 of the top wall 13 above the slot 12, into the housing 10 and communicating with the central slot 12 so that the free end 75 of the engagement beam 68 of the upper row contact 60 can be received in such channel 15 when the daughter board 100 is received within the socket connector 1 and the lower edge portion 101 of the board 100 deflects the upper row contact 60 upwardly. The upper row passageway 14 further includes a lower channel 19 rearward extending from the front surface 32 of the bottom wall 34 of the housing 10 so that the retention section 66 of the upper row contact 60 can be retainably received therein.

Figure 6B:
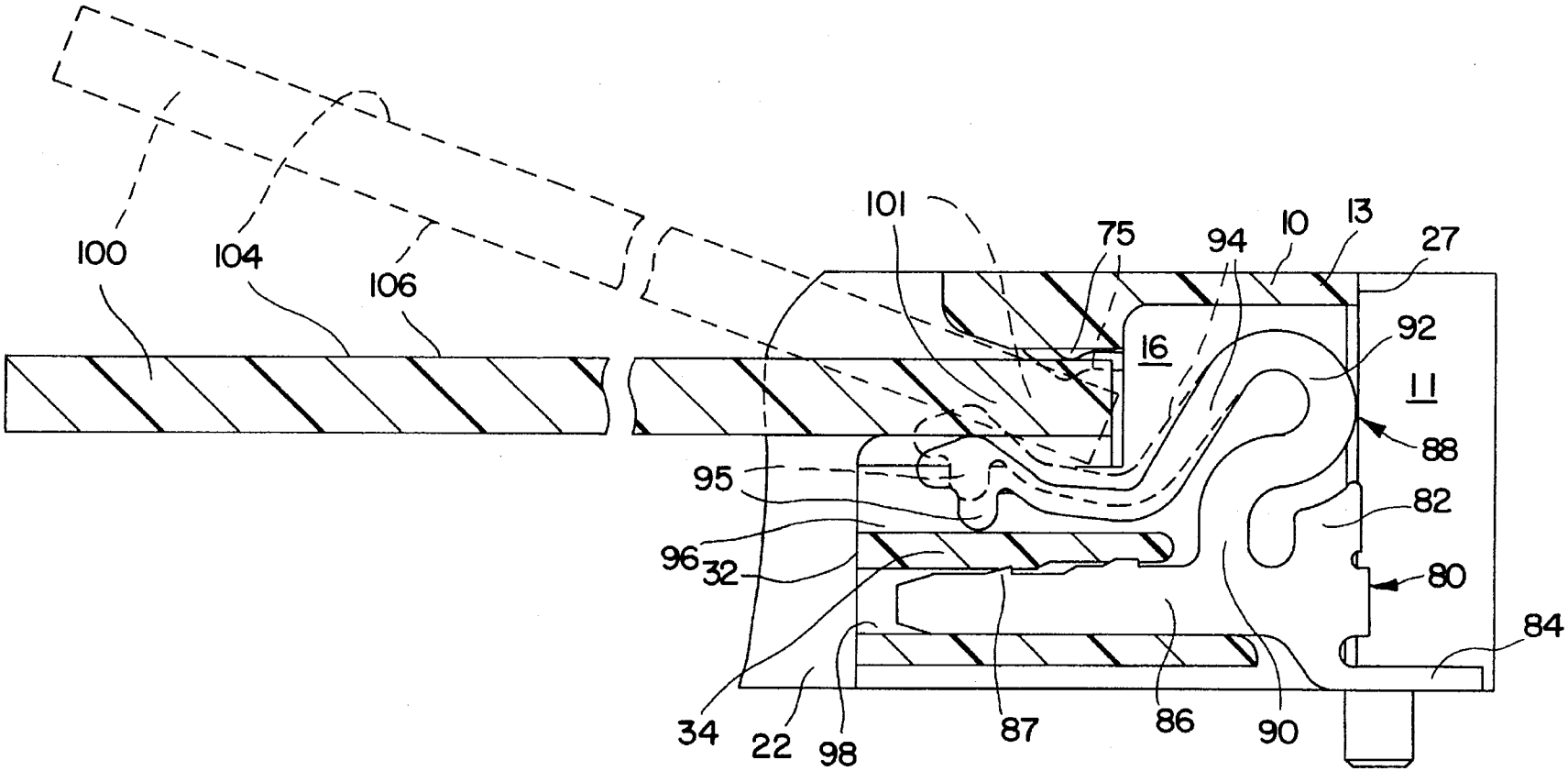
FIG. 6(B) is a partial cross-sectional view of the socket connector of FIG. 1 to show the lower row contact therein when the daughter board is inserted therein.

Similar to the upper row contact 60, as shown in FIGS. 1, 5(B) and 6(B), the lower row contact 80 has a base 82 from which the tail 84 extends rearward and the retention section 86 extends forwardly wherein the retention section 86 has barbs 87 thereon. An engagement beam 88 extends upwardly from the retention section 86 adjacent the base 82. The engagement beam 88 has a vertical first section 90 extending from the retention section 86, a curved second section 92 successively extending upwardly from the end of the first second 90 wherein the rear edge of the second section 92 is positioned flush with the rear surface 27 of the housing 10, and an angled third section 94 extending forwardly and downward from the end of the second section 92. The angled third section 94 includes a claw-like member 95 at its free end extending into the slot 12 for engagement with the circuit traces 108 on the bottom surface 106 of the daughter board 100.

Corresponding to the lower row contact 90, each lower row passageway 16 includes a first lower channel 96 rearward extending from the front surface 32 of the bottom wall 34 and communicating with the central slot 12 so that the claw-like member 95 at the free end of the engagement beam 88 of the lower row contact 80 can be received in the channel 96 when the daughter board 100 is received within the socket connector 1. Similar to the upper row passageway 14, the lower row passageway 16 further includes a second lower channel 98 spaced below the first lower channel 98 and rearward extending from the front surface 32 of the bottom wall 34 of the housing 10 so that the retention section 86 of the lower row contact 80 can be retainably received therein.

A feature of the invention is that the curved second sections 72 and 92 of the upper row contact 60 and the lower row contact 80 both extend from a forward position and to a rearward position and again forwardly to increase the length of arm of force for obtaining a best elasticity coefficient to perform a superior resilience. Also, the rear edges of the curved second sections 72 and 92 are exposed proximate the rear surface 27 of the housing 10, and thus it is easy to inspect for assuring if the free end 75, 95 of the engagement beams 68 and 88 are expected to be in a predetermined positioned for precise engagement with the circuit traces on the daughter board 100.

It is desired to have the generally equal elasticity coefficient on both lower row contact 60 and the lower row contact 80 so that the daughter board 100 can be properly even forced in both, i.e., upward and downward, directions. Because the length of the engagement beam 88 of the lower row contact 80 is considerably larger than that of the engagement beam 68 of the upper row contact 60, the first section 90 and the second section 92 of the lower row contact 80 designedly have widened dimensions for intentionally increasing stiffness thereof.

Figure 3A:
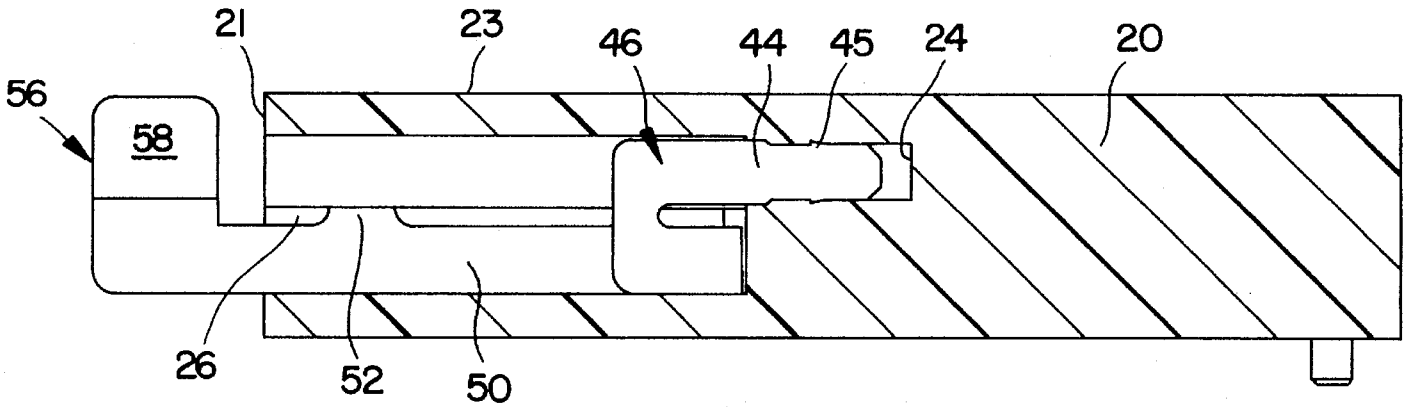
FIG. 3(A) is a cross-sectional view of the socket connector of FIG. 1 cut along the right side engagement arm to show the relation between the groove and the cavity of the housing and the latch therein.
Figure 3B:
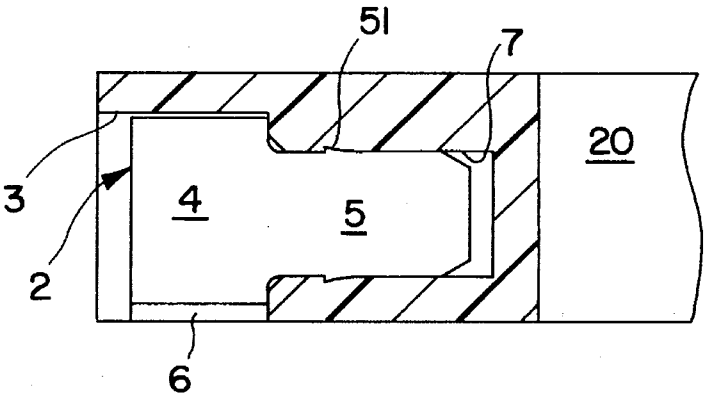
FIG. 3(B) is a partial cross-sectional view of the socket connector of FIG. 1 cut along the right side engagement arm to show the relation between the recess of the housing and the retaining bracket.

In the preferred embodiment, as shown in FIGS. 1 and 3(B), beside each latch 40 a retaining bracket 2 is inserted in the housing 10. Each retaining bracket 2 includes a plate 4 of which a narrow retention blade 5 associated with barbs 51 extends rearward from the rear edge and a mounting pad 6 integrally extends outwardly horizontally from the bottom edge. To correspond to the retaining bracket 2, the housing 10 includes a rearward extending recess 3 and an associated aligned narrow indent 7 for retainably receiving the plate 4 and retention blade 5 therein. A lateral opening 8 is positioned at the bottom corner of arm 20 adjacent the front end surface 21 of the arm 20 so that the mounting pad 6 can outwardly project therefrom. It can be understood that the retaining bracket 2 is designedly separated from the latch 40 so that the forces imposed on the latch will not be directly transferred to such mounting pad 6 of the retaining bracket 2, thus assuring good mounting of the socket connector 1 on the mother board (not shown).

It is appreciated that unlike the U-shaped type latch disclosed in the prior patent references, in the present invention the U-shaped body 46 of the latch 40 is substantially terminated at the lower portion of the main base 42 and the retention blade 44 independently individually extends from the upper portion of the main base 42, so that the deflection of the U-shaped body 46 of the latch hardly influences the stability of such retention blade 44. In other words, the invention provides a latch having the advantage of the U-shaped body without the aforementioned disadvantage thereof disclosed in the prior U.S. patents. It is also contemplated that in comparison with some other exposed retention means of the latch, the retention blade 44 of the latch 40 is protectively deep embedded within the housing 10 so that the latch 40 in the invention is reliable and has a long life-time.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A socket connector adapted to mountably lie on a mother board for reception of a daughter board therein, comprising:

an insulative elongated housing having a central slot extending in a lengthwise direction along said housing;

a plurality of upper row passageways and lower row passageways staggered one another along said slot for receiving a plurality of upper row contacts and lower row contacts therein, respectively;

a pair of engagement arms extending forwardly at two opposite ends of the housing, each engagement arm having a platform for supporting the daughter board thereon; and a latch horizontally positioned in each engagement arm, said latch further including:

a main base;

a retention blade rearwardly extending from an upper portion of a rear edge of said main base;

a generally U-shaped body extending from a lower portion of the rear edge of said main base;

an extension section forwardly extending from an end of the U-shaped body;

a hook section upwardly extending from said extension section adjacent said U-shaped body; and a lever section upwardly extending from a free end of said extension section.

2. The socket connector as described in claim 1, wherein said engagement arm includes a slit-like groove for receiving the main base and the retention blade of the latch, a cavity communicatively positioned adjacent said groove for receiving the U-shaped body and the extension section of the latch, and a top opening for receiving the upwardly extending hook section of the latch.

3. The socket connector as described in claim 2, wherein an independent retaining bracket is positioned beside each latch, said retaining bracket including a vertical plate, a retention blade extending rearward from a rear edge of said plate, and a mounting pad outwardly horizontally extending from a bottom edge of said plate.

4. The socket connector as described in claim 3, wherein the engagement arm further includes a recess and an associated aligned indent, and a lateral opening therein for receiving said retaining bracket therein.

5. The socket connector as described in claim 1, wherein each upper row contact has a base from which a mounting leg downward extends and a retention section forwardly extends, and an engagement beam upwardly extends from said retention section and is spaced from said base, said engagement beam further including a vertical first section extending from the retention section, a curved second section extending from the first section, and a generally horizontal third section extending from the second section, whereby a free end of the third section extends into the central slot, and a rear edge of the second section is exposed adjacent a rear surface of the housing.

6. The socket connector as described in claim 5, wherein each upper passageway further includes an upper channel extending from a front surface of a top wall above said central slot for receiving the engaged free end of the engagement beam of the upper row contact, and a lower channel extending from a front surface of a bottom wall below the central slot for retainably receiving the retention section of the upper row contact.

7. The socket connector as described in claim 5, wherein each lower row contact includes a base from which a mounting leg rearward extends and a retention section forwardly extends, and an engagement beam extends from said retention section and is spaced from said base, said engagement beams of the lower row contact further including a vertical first section extending upwardly from the retention section, a curved second section extending from said first section, and an angled third section extending forwardly and downward from the second section whereby a free end of said third section extends into the central slot and an rear edge of the second section is visible adjacent the rear surface of the housing.

8. The socket connector as described in claim 7, wherein each lower row passageway further includes a first lower channel and a second lower channel both extending from the front surface of the bottom wall for receiving the engaged free end of the engagement beam of the lower row contact and for retainably receiving the retention section of the lower row contact, respectively.

9. The socket connector as described in claim 7, wherein the first section and the second section of the lower row contact is wider than the first section and the second section of the upper row contact.

10. A socket connector (1) adapted to mountably lie on a mother board for reception of a daughter board (100) therein, comprising:

an insulative elongated housing (10) having a central slot (12) extending lengthwise along said housing (10);

a plurality of upper row passageways (14) and lower row passageways (16) staggered one another along said slot (12) for receiving a plurality of upper row contacts (60) and lower row contacts (80) therein, respectively;

a pair of engagement arms (20) extending forwardly at two opposite ends of the housing (10), each engagement arm (20) having a platform (22) for supporting the daughter board (100) thereon; and a latch (40) horizontally positioned in each engagement arm (20), wherein each upper row contact (60) has a base (62) from which a mounting leg (64) downward extends and a retention section (66) forwardly extends, and an engagement beam (68) upwardly extends from said retention section (66) and is spaced from said base (62), said engagement beam (68) further including a vertical first section (70) extending from the retention section (66), a curved second section (72) extending from the first section (70), and a generally horizontal third section (74) extending from the second section (72), whereby a free end (75) of the third section (74) extends into the central slot (12), and a rear edge of the second section (72) is exposed adjacent a rear surface (27) of the housing (10);

and each lower row contact (80) includes a base (82) from which a mounting leg (84) rearward extends and a retention section (86) forwardly extends, and an engagement beam (88) extends from said retention section (86) and is spaced from said base (82), said engagement beams (88) of the lower row contact (80) further including a vertical first section (90) extending upwardly from the retention section (86), a curved second section (92) extending from said first section (90), and an angled third section (94) extending forwardly and downward from the second section (92) whereby a free end of said third section (94) extends into the central slot (12) and an rear edge of the second section (92) is visible adjacent the rear surface (27) of the housing (10).

11. The socket connector (1) as described in claim 10, wherein each upper passageway (14) further includes an upper channel (15) extending from a front surface (17) of a top wall (13) above said central slot (12) for receiving the engaged free end (75) of the engagement beam (68) of the upper row contact (60), and a lower channel (19) extending from a front surface (32) of a bottom wall (34) below the central slot (12) for retainably receiving the retention section (66) of the upper row contact (60).

12. A socket connector (1) adapted to mountably lie on a mother board for reception of a daughter board (100) therein, comprising:

an insulative elongated housing (10) having a central slot (12) extending lengthwise along said housing (10);

a plurality of upper row passageways (14) and lower row passageways (16) staggered one another along said slot (12) for receiving a plurality of upper row contacts (60) and lower row contacts (80) therein, respectively;

a pair of engagement arms (20) extending forwardly at two opposite ends of the housing (10), each engagement arm (20) having a platform (22) for supporting the daughter board (100) thereon; and a latch (40) horizontally positioned in each of said engagement arms (20), wherein each upper row contact (60) has a base (62) from which a mounting leg (64) downwardly extends and a retention section (66) forwardly extends, and an engagement beam (68) upwardly extends from said retention section (66) and is spaced from said base (62), said engagement beam (68) further including a vertical first section (70) extending from the retention section (66), a curved second section (72) extending from the first section (70), and a generally horizontal third section (74) extending from the second section (72), whereby a free end (75) of the third section (74) extends into the central slot (12), and a rear edge of the second section (72) is exposed adjacent a rear surface (27) of the housing (10);

each lower row contact (80) includes a base (82) from which a mounting leg (84) rearward extends and a retention section (86) forwardly extends, and an engagement beam (88) extends from said retention section (86) and is spaced from said base (82), said engagement beams (88) of the lower row contact (80) further including a vertical first section (90) extending upwardly from the retention section (86), a curved second section (92) extending from said first section (90), and an angled third section (94) extending forwardly and downward from the second section (92) whereby a free end of said third section (94) extends into the central slot (12) and an rear edge of the second section (92) is visible adjacent the rear surface (27) of the housing (10);

and because the length of the engagement beam (88) of the lower row contact (80) is considerably larger than that of the engagement beam (68) of the upper row contact (60), the first section (90) and the second section (92) of the lower row contact (80)are wider than the first section (70) and the second section (72) of the upper row contact (60) for obtaining generally equal elasticity coefficient on both of the lower row contact (80) and the upper row contact (60).

* * * * *